US006734408B2

(12) United States Patent
Shin

(10) Patent No.: US 6,734,408 B2
(45) Date of Patent: May 11, 2004

(54) WALL-MOUNTED TYPE MICROWAVE OVEN

(75) Inventor: Jong-Hyuck Shin, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/300,600

(22) Filed: Nov. 21, 2002

(65) Prior Publication Data

US 2004/0000548 A1 Jan. 1, 2004

(30) Foreign Application Priority Data

Jun. 29, 2002 (KR) ..... 2002-37609

(51) Int. Cl.[7] ..... H05B 6/80

(52) U.S. Cl. ..... 219/758; 219/756; 219/757; 362/92; 126/273 A; 126/213

(58) Field of Search ..... 219/757, 758, 219/756; 362/92, 93, 94, 226; 126/273 A, 275 E, 213, 299 R

(56) References Cited

U.S. PATENT DOCUMENTS

| | | | | |
|---|---|---|---|---|
| 4,313,043 A | | 1/1982 | White et al. | 219/756 |
| 5,423,605 A | * | 6/1995 | Liu | 312/265.6 |
| 5,722,759 A | * | 3/1998 | Eklov et al. | 362/464 |
| 6,420,690 B1 | * | 7/2002 | Kim | 219/757 |

* cited by examiner

*Primary Examiner*—Philip H. Leung
(74) *Attorney, Agent, or Firm*—Staas & Halsey LLP

(57) ABSTRACT

A wall-mounted type microwave oven including an improved coupling structure of a guide bracket to reduce manufacturing cost and manufacturing time is provided. The guide bracket has a hook protrusion at a front end, which is extended forwardly by a certain length. The base plate has a slot, into which the hook of the guide bracket is fitted. The guide bracket has a rear coupling portion at a rear end, which is extended laterally. The base plate has a rib to be in contact with the rear coupling portion. The rib has a hook at an upper end, by which the rear coupling portion of the guide bracket is held.

12 Claims, 6 Drawing Sheets

WALL-MOUNTED TYPE MICROWAVE OVEN

CROSS-REFERENCE TO RELATED APPLICATION

This application claims the benefit of Korean Application No. 2002-37609, filed Jun. 29, 2002, in the Korean Intellectual Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven which includes an improved coupling structure of a guide bracket, mounted on a base plate, to guide a harness to allow electric power to be supplied to a lamp therethrough.

2. Description of the Related Art

In general, a wall-mounted type microwave oven is mounted on a kitchen wall over a gas oven, and is designed to carry out not only cooking as in a usual microwave oven, but also exhausting gas, fumes and odors generated by the gas oven, disposed therebelow, to an outside of a room.

FIG. 1 shows an internal structure of a conventional wall-mounted type microwave oven, which is provided with a base plate. As shown in the drawing, the conventional wall-mounted type includes an oven body 10 defining a cooking chamber 11 and an electric component compartment 12 therein, which are isolated from each other.

The microwave oven is provided with exhaust flow paths 13, which are defined between side walls of the cooking chamber 11 and the electric component compartment 12, and side walls of the oven body 10, to exhaust gas and fumes generated by a gas oven (not shown) disposed therebelow. The oven body 1 is provided at an upper and rear portion with an exhaust fan 15 to suck the gas and fumes generated by the gas oven through the exhaust flow path 14 and to discharge the gas and fumes generated by the gas oven to the outside of the room.

The electric component compartment 12 is provided in the oven body with a cooling fan 15 therein to cool electrical components mounted in the electric component compartment 12, and a magnetron 16 and a high voltage condenser 17 generating high-frequency electromagnetic waves into the cooking chamber 11 to cook food disposed in the cooking chamber 11.

The bottom surface of the oven body 10 is attached with a base plate 20, which is spaced from bottom surfaces of the cooking chamber 11 and the electric component compartment 12 by a certain distance. The base plate 20 is typically a rectangular metal plate. The base plate 20 is provided at a rear portion with a lamp 21, which illuminates the gas oven to enable a user to conveniently carry out cooking operations on the gas oven, and is provided at sides of a front portion of the base plate 20 with a pair of intake ports 22 and 23 to allow the gas and fumes generated by the gas oven to be introduced into the exhaust flow paths 13 therethrough. The base plate 20 is provided between the pair of intake ports 22 and 23 with a guide bracket 24 to prevent a harness 25, which is adapted to allow electric power to be supplied to the lamp 21 therethrough, from deviating from a normal position and thus, preventing the harness 25 from entering the intake ports 22 and 23, and from coming into contact with other components.

As shown in FIG. 2, since the bottom portion of the guide bracket 24 and the base plate 20 corresponding to the bottom portion of the guide bracket 24 are formed with a plurality of screw holes 24*a* and 24*b*, respectively, so that the guide bracket 24 is attachable to the base plate 20 by a plurality of screws 26. The harness 25 is disposed in the guide bracket 24 attached to the base plate 20, so as not to be separated therefrom.

However, since the conventional wall-mounted type microwave oven is constructed such that the guide bracket 20 guiding the harness 25 is attached to the base plate 20 between the pair of intake ports 22 and 23 by screws 26, manufacturing cost and time are increased due to an increase in components and a joining operation by screws.

SUMMARY OF THE INVENTION

Accordingly, it is an aspect of the present invention to provide a wall-mounted type microwave oven, which includes an improved coupling structure of a guide bracket to reduce manufacturing costs and manufacturing time is provided.

Additional aspects and advantages of the invention will be set forth in part in the description which follows and, in part, will be obvious from the description, or may be learned by practice of the invention.

In order to accomplish the above and other aspects, a wall-mounted type microwave oven comprising: an oven body defining an appearance of the microwave oven; a base plate attached to a bottom surface of the oven body, which is provided at a rear portion of the base plate with a lamp and is provided at a front portion of the base plate with a pair of intake ports; and a guide bracket mounted on the base plate and positioned between the pair of intake ports to guide a harness supplying electric power to the lamp, the guide bracket being coupled to the base plate by a fitting.

The guide bracket may be provided at a front end of the guide bracket with a hook protrusion, which is extended in a forward direction by a certain length, and the base plate may be provided with a slot, into which the hook protrusion of the guide bracket is fitted.

The guide bracket may be provided at a rear end of the guide bracket with a rear coupling portion, which is extended laterally, and the base plate may be provided with a rib, which is in contact with the rear coupling portion, the rib being provided at an upper end with a hook protrusion, by which the rear coupling portion of the guide bracket may be caught.

The hook protrusion may be made of a flexible material, such that the hook may be bent toward the rear coupling portion so as to hold the rear coupling portion.

BRIEF DESCRIPTION OF THE DRAWINGS

These and other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
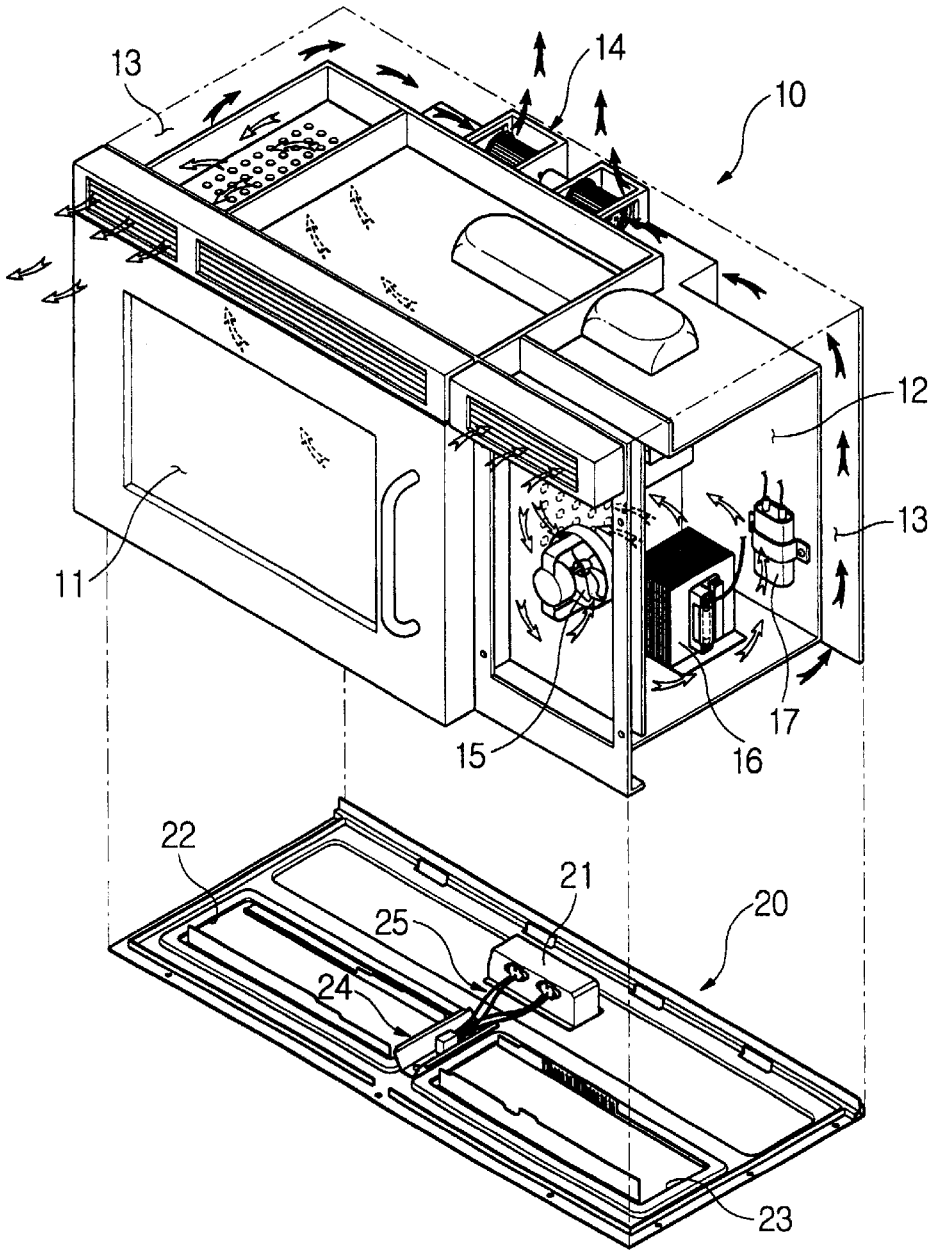
FIG. 1 (PRIOR ART)
FIG. 1 is a perspective view of a conventional wall-mounted type microwave oven in which a base plate is removed from an oven body.
Figure 2:
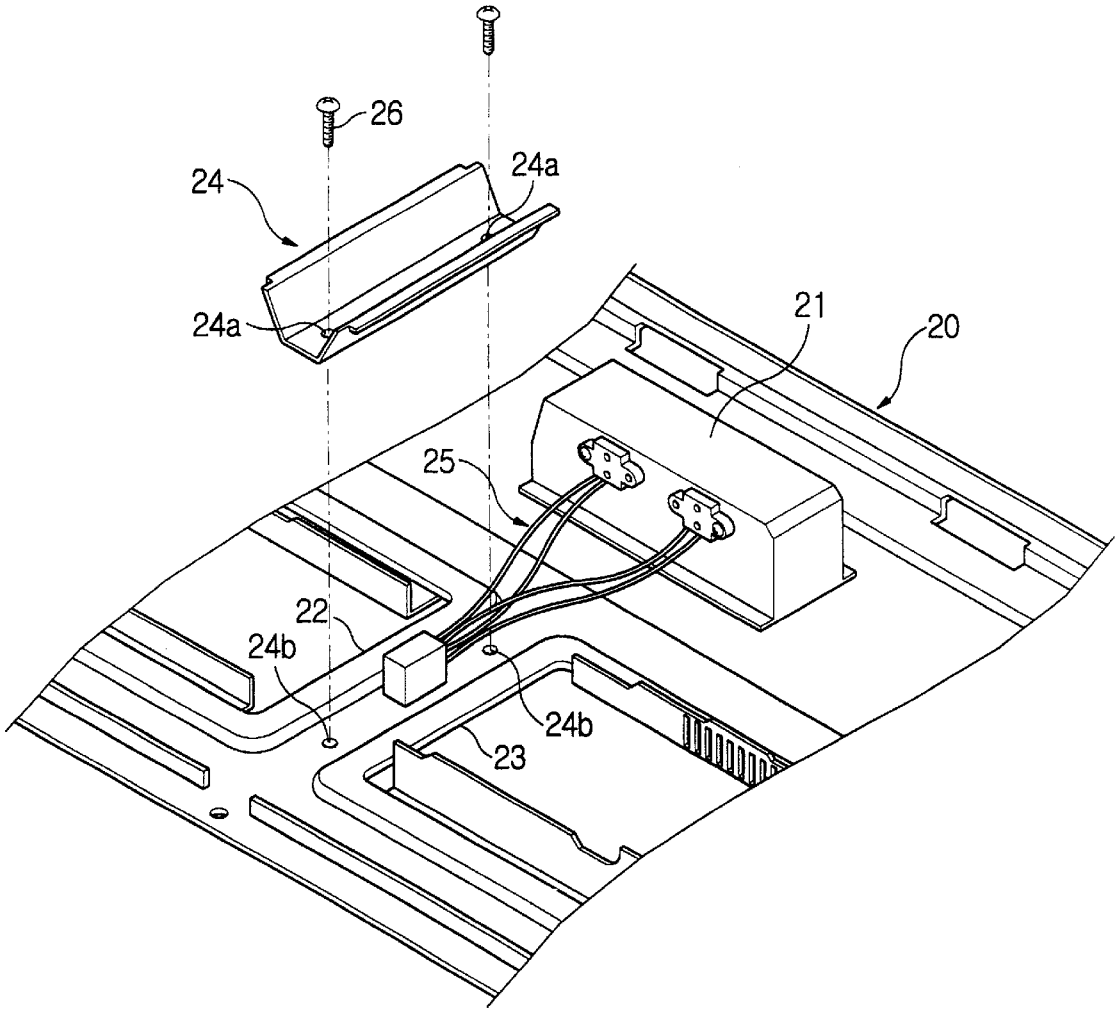
FIG. 2 (PRIOR ART)
FIG. 2 is a partial perspective view of the wall-mounted type microwave oven of FIG. 1, which shows a structure to couple a guide bracket guiding a harness to the base plate.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
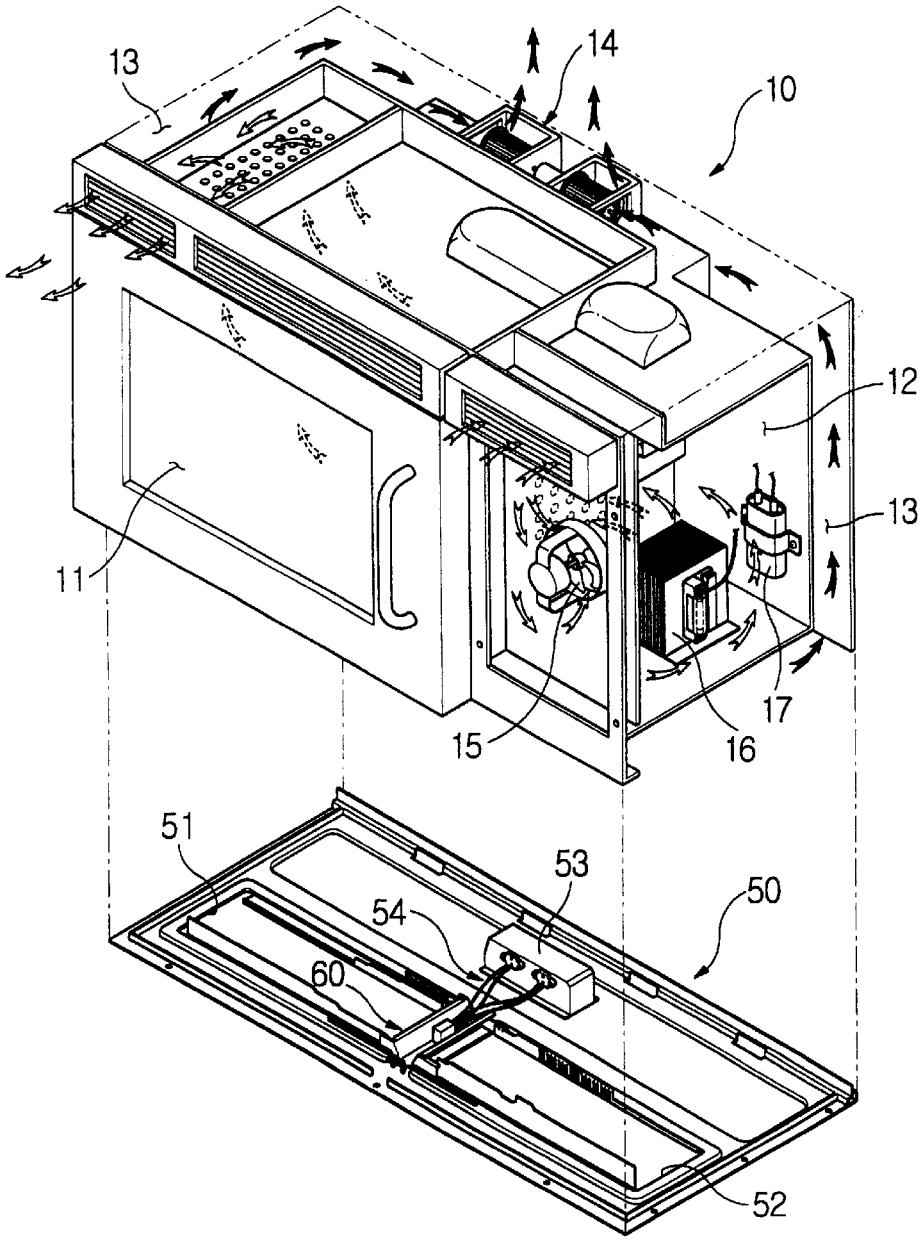
FIG. 3 is a perspective view of a wall-mounted type microwave oven according to an embodiment of the present invention in which a base plate is separated from an oven body.

FIG. 3 schematically shows an internal structure of a wall-mounted type microwave oven according to an embodiment of the present invention. As shown in FIG. 3, an oven body 10 of the microwave oven includes a cooking chamber 11 and an electric component compartment 12 therein. The microwave oven is provided with exhaust flow paths 13, which are defined between side walls of the cooking chamber 11 and the electric component compartment 12, and the side walls of the oven body 10, to exhaust gas and fumes. The oven body 10 is provided at an upper and rear portion with an exhaust fan 14 to discharge the gas and fumes to an outside of a room.

A base plate 50 is attached to a bottom surface of the oven body 10 such that the base plate 50 is spaced from the bottom surface of both the cooking chamber 11 and the electric component compartment 12 by a certain distance. The base plate 50 is provided at each side of a front portion of the base plate 50 with a pair of intake ports 51 and 52, which are spaced from each other by a certain distance and allow outside gas and fumes to be introduced into the exhaust flow path 13 therethrough. The base plate 50 is further provided at a rear portion with a lamp 53 to illuminate an area below the microwave oven, thereby allowing a user to conveniently carry out cooking operations on a gas oven disposed therebelow. The lamp 53 is connected to a harness 54 comprising a bundle of electric wires to supply electric power to the lamp 53.

To connect the harness 54 to a power supply terminal, the harness 54 must be guided such that the harness 54 does not protrude into the intake ports 51 and 52 of the base plate 50 and does not come into contact with other components. Therefore, a guide bracket 60 is provided between the pair of intake ports 51 and 52.

Figure 4:
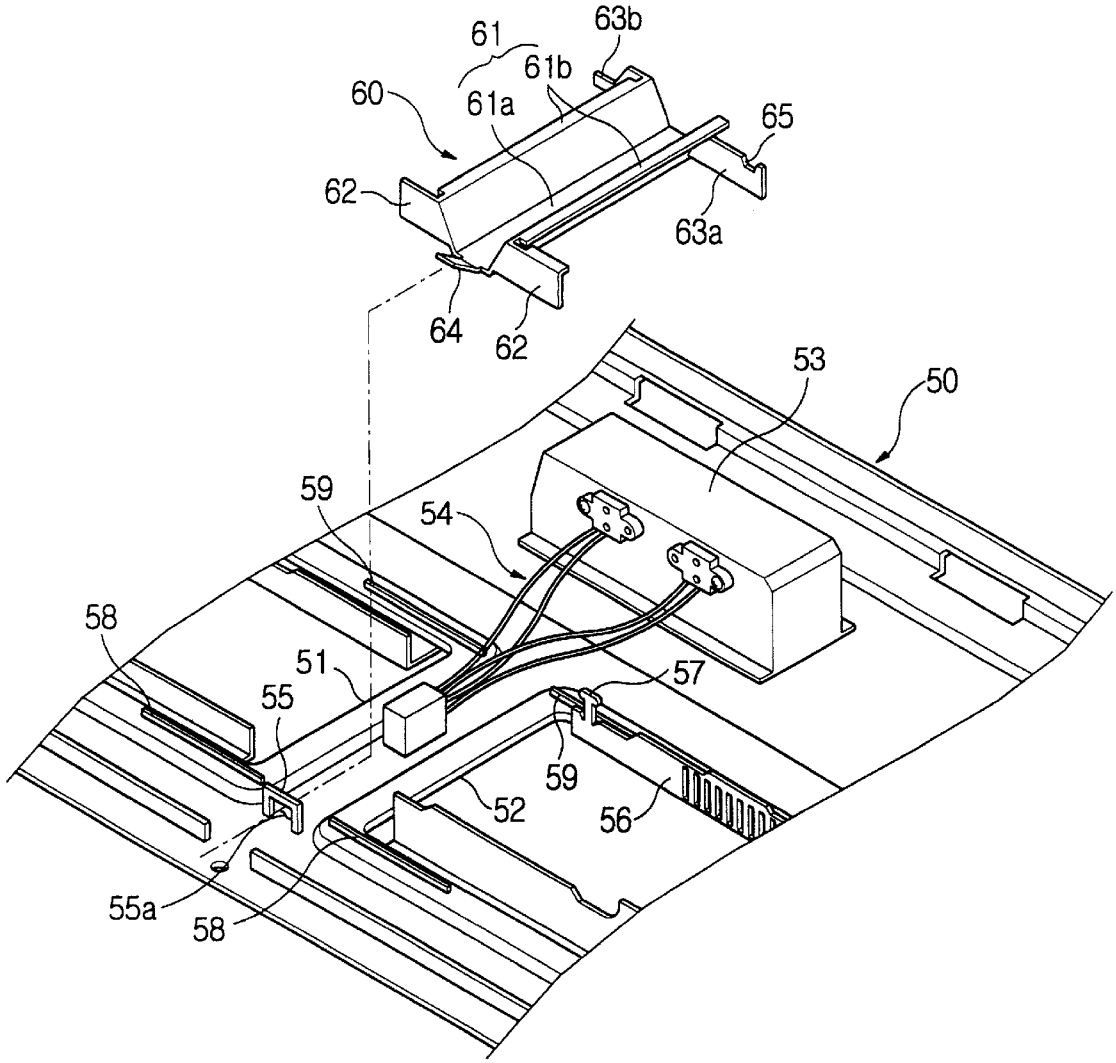
FIG. 4 is a partial perspective view of the wall-mounted type microwave oven of FIG. 3, in which a guide bracket is removed from the base plate.
Figure 5:
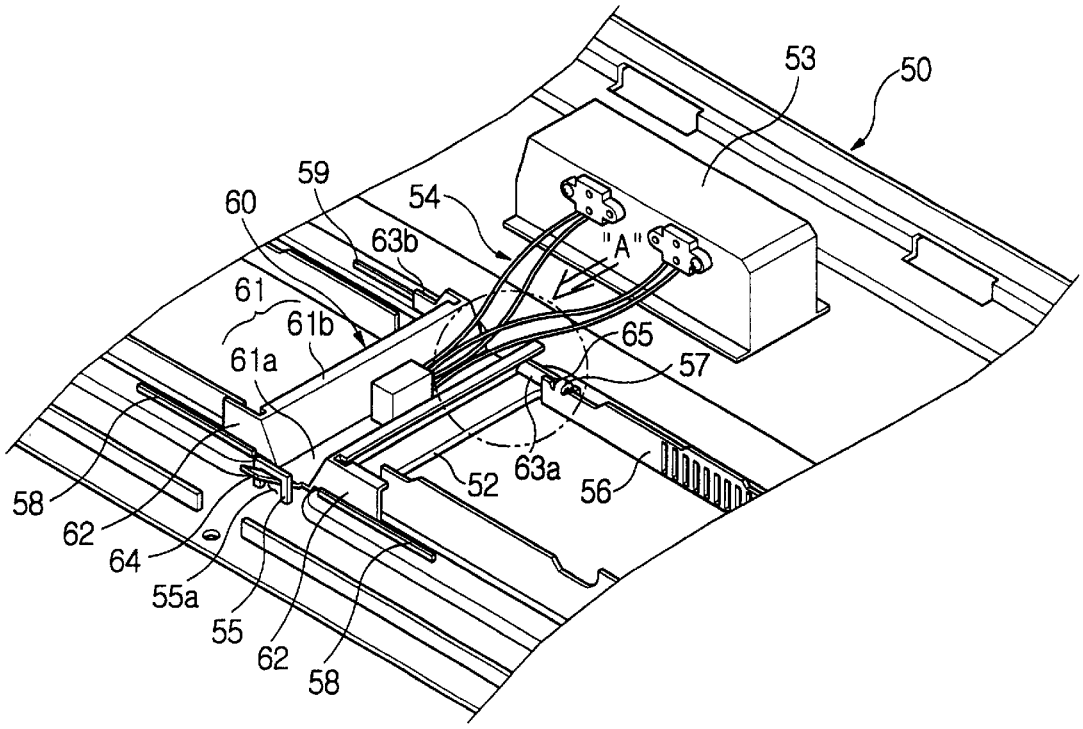
FIG. 5 is a partial perspective view of the wall-mounted type microwave oven of FIG. 3, in which the guide bracket is coupled to the base plate.

FIGS. 4 and 5 show a coupling of the guide bracket 60 to the base plate 50, in which FIG. 4 shows the guide bracket 60 separated from the base plate 50 and FIG. 5 shows the guide bracket 60 coupled to the base plate 50.

As shown in FIGS. 4 and 5, the guide bracket 60 includes a bracket body 61 comprising a bottom plate 61*a* and wing plates 61*b* extended from both ends of the bottom plate 61*a* upwardly and outwardly, a pair of front leg portions 62 extended from front ends of the wing plates 61*b* outwardly, and a pair of rear leg portions 63*a* and 63*b* extended outwardly from rear ends of the wing plates 61*b*.

The bottom plate 61*a* of the guide bracket 60 is provided at a front end with a hook protrusion 64, which is extended therefrom by a certain length. One of the pair of rear leg portions 63*a* and 63*b*, in this case the rear leg portion 63*a*, is provided with a hook cut 65, by which the guide bracket 60 is coupled to the base plate 50. Therefore, the rear leg portion 63*a* will be referred to as a rear coupling portion hereinafter.

As shown in FIG. 4, the hook protrusion 64 is obliquely extended from the bottom plate 61*a* of the guide bracket 60 forwardly and upwardly, and the rear coupling portion 63*a* is formed on an upper end of the guide bracket 60 to be depressed downwardly.

The base plate 50 is provided with a reception member 55 having a slot 55*a*, and is extended upwardly, in front of an intermediate position between the pair of intake ports 51 and 52. The hook protrusion 64 of the guide bracket 60 is fitted into the slot 55*a* of the reception member 55. The intake port 52 is provided at a rear edge of the intake port 52 with a rib 56, which is integrally equipped with a hook 57 to engage with the hook cut 65 of the guide bracket 60, so as to hold the guide bracket 60.

The hook protrusion 64 provided at a front end of the guide bracket 60 and the slot 55*a* of the reception member 55 provided on the base plate 50 comprises a first coupling unit coupling the front end of the guide bracket 60 to the base plate 50. The rear coupling portion 63*a* provided at a rear end of the guide bracket 60, and having the hook cut 65 and the hook 57 provided at the base plate 50, comprises a second coupling unit coupling the rear end of the guide bracket 60 to the base plate 50.

The slot 55*a* is formed at the reception member 55 vertically projected from the base plate 50, and the hook protrusion 64 is shaped to be fitted into the slot 55*a* and then extended from the slot 55*a* upwardly and forwardly.

The rib 56 is upwardly extended from the rear edge of the intake port 52 by a certain length, and is provided at an upper end with the hook 57 having a "T" shape. The hook 57 has a predetermined thickness such that the hook 57 can be bent by a hand of a user. Further, after the rear coupling portion 63*a* of the guide bracket 60 is engaged to the rib 56, the hook 57 is bent to be engaged with the hook cut 65 of the rear coupling portion 63*a*, thereby holding the rear end of the guide bracket 60.

The base plate 60 is provided with linear protrusions 58 and 59 at locations corresponding to outer surfaces of the front leg portions 62 of the guide bracket 60 and the rear leg portions 63*a* and 63*b* to position the guide bracket 60, thereby affording a convenient coupling operation of the guide bracket 60.

An operation of coupling the guide bracket 60 to the base plate 50 with the first and second coupling units will now be described with reference to FIGS. 5 and 6.

The hook protrusion 64 of the guide bracket 60 is first inserted into the slot 55*a* of the reception member 55 of the base plate 50 to be projected forwardly from the reception member 55. Further, an end of the hook protrusion 64 is positioned over the slot 55*a* while the front leg portions 62 of the guide bracket 60 are engaged with the front linear protrusions 58.

Figure 6:
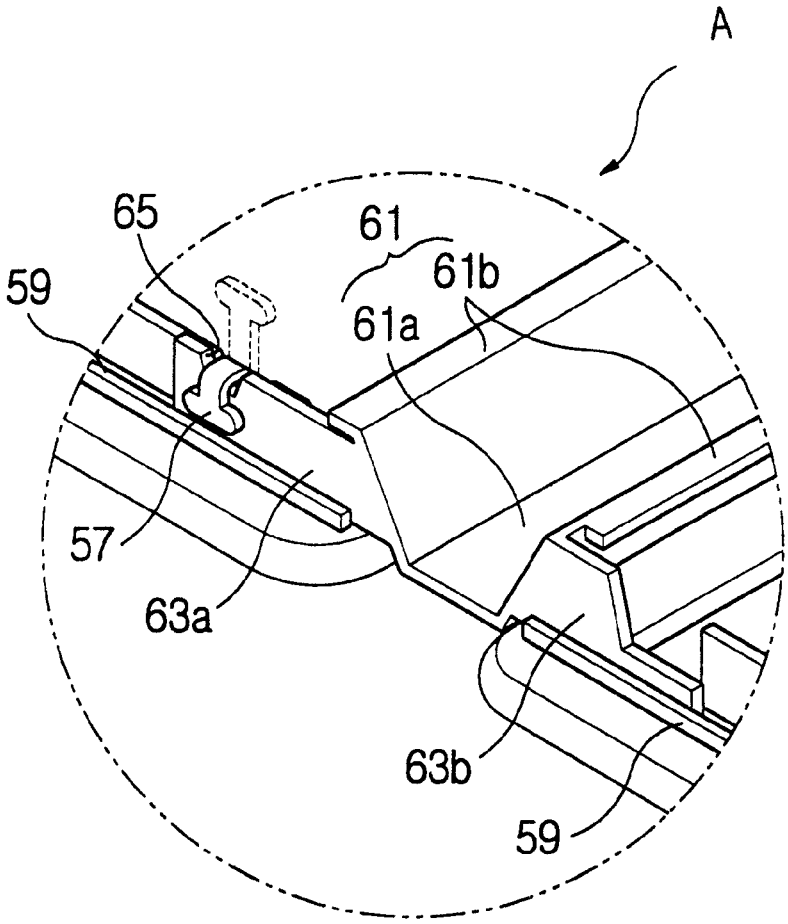
FIG. 6 is an enlarged perspective view of area A, of FIG. 5.

After the guide bracket 60 is coupled to the base plate 50 by the first coupling unit in the above-described manner, the rear leg portions 63*a* and 63*b* are engaged with the rear linear protrusions 59 to be positioned in place while the rear coupling portion 63*a* is in close contact with the rib 56, as specifically shown in FIG. 6.

In this state, the hook 57 provided at the rib 56 is positioned over the hook cut 65 of the rear coupling portion 63*a*, as indicated by the dotted line in FIG. 6. Subsequently, the hook 57 is bent toward the rib 56 and then comes into close contact with the rear coupling portion 63*a* while being engaged with the hook cut 65. Thus, the rear coupling portion 63*a* of the guide bracket 60 is coupled to the rib 56 of the base plate 50.

After the hook protrusion 64 of the guide bracket 60 is fitted into the slot 55*a* of the reception member 55 of the base plate 50, the rear coupling portion 63*a* of the guide bracket 60 is caused to be in contact with the rib 56 of the base plate 50, and the hook 57 of the rib 56 is bent toward the rear coupling portion 63*a* and then the hook 57 of the rib 56 is caused to be in close contact with the rear coupling portion 63*a*. Thus, the guide bracket 60 can be simply and quickly coupled to the base plate 50.

Once the guide bracket 60 is completely coupled to the base plate 50, the harness 54 to supply electric power to the lamp 53 is positioned on the bottom plate 61*a* of the guide bracket 60 and between the wing plates 61*b*. Therefore, the harness 54 is retained in the guide bracket 60 without leftward and rightward deviation from a normal position of the harness 54, and connected to the power supply terminal (not shown).

Although only one hook is described to be engaged to only one rear coupling portion to couple the guide bracket to the base plate, two or more hooks may be provided to be engaged to both the rear leg portions.

As described above, a wall-mounted type microwave oven is provided, in which a guide bracket guiding a harness can be coupled to a base plate of the microwave oven in a simple manner without fastening by screws, resulting in a reduction in a number of components and assembling time. This enables reduced manufacturing costs and improved productivity.

Although a preferred embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A wall-mounted type microwave oven, comprising:

an oven body defining an appearance of the microwave oven;

a base plate attached to a bottom surface of the oven body including a lamp at a rear portion thereof and a pair of intake ports at a front portion thereof; and a guide bracket mounted on the base plate and positioned between the pair of intake ports to guide a harness supplying electric power to the lamp, wherein:

the guide bracket comprises a front end with a hook protrusion, which is extended forwardly by a certain length; and the base plate comprises a slot, into which the hook protrusion of the guide bracket is fitted.

2. The microwave oven as set forth in claim 1, wherein the hook protrusion is extended in a forward direction and upwardly such that an end of the hook protrusion is positioned over the slot, thereby retaining the guide bracket in place without a forward displacement or a rearward displacement.

3. The microwave oven as set forth in claim 1, wherein:

the guide bracket further comprises a rear coupling portion at a rear end thereof, which is extended laterally; and the base plate further comprises a rib to contact with the rear coupling portion of the guide bracket, and an upper end of the rib having a hook to catch the rear coupling portion of the guide bracket.

4. The microwave oven as set forth in claim 3, wherein the hook is made of a flexible material, such that the hook is bent to hold the rear coupling portion.

5. The microwave oven as set forth in claim 4, wherein the rear coupling portion comprises a cut portion at an upper end thereof, the cut portion being engagable with the bent hook.

6. The microwave oven as set forth in claim 3, wherein:

the guide bracket further comprises:

a pair of front leg portions integrally provided at the front end of the guide bracket, and a rear leg portion and the rear coupling portion integrally provided at the rear end, of the guide bracket; and the base plate further comprises:

linear protrusions provided at locations corresponding to the front leg portions and the rear leg and coupling portions such that the front and rear leg portions and the rear coupling portion of the guide bracket are engaged to the linear protrusions, thereby positioning the guide bracket.

7. A wall-mounted type microwave oven, comprising:

an oven body defining an appearance of the microwave oven;

a base plate attached to a bottom surface of the oven body including a lamp at a rear portion thereof and a pair of intake ports at a front portion thereof; and a guide bracket mounted on the base plate and positioned between the pair of intake ports to guide a harness supplying electric power to the lamp, the guide bracket being coupled to the base plate by a fitting, wherein:

the guide bracket comprises a rear coupling portion at a rear end thereof, which is extended laterally; and the base plate comprises a rib to contact with the rear coupling portion of the guide bracket, and an upper end of the rib having a hook to catch the rear coupling portion of the guide bracket.

8. The microwave oven as set forth in claim 7, wherein the hook is made of a flexible material, such that the hook is bent to hold the rear coupling portion.

9. The microwave oven as set forth in claim 8, wherein the rear coupling portion comprises a cut portion at an upper end thereof, the cut portion being engagable with the bent hook.

10. The microwave oven as set forth in claim 7, wherein:

the guide bracket further comprises:

a front end, a pair of front leg portions integrally provided at the front end of the guide bracket, and a rear leg portion and the rear coupling portion integrally provided at the rear end, of the guide bracket; and the base plate further comprises:

linear protrusions provided at locations corresponding to the front leg portions and the rear leg and coupling Portions such that the front and rear leg portions and the rear coupling portion of the guide bracket are engaged to the linear protrusions, thereby positioning the guide bracket.

11. The microwave oven as set forth in claim 7, wherein:

the guide bracket further comprises a hook protrusion protruding from one end thereof; and the base plate further comprises a slot, into which the hook protrusion is mated to couple the guide bracket to the base plate.

12. The microwave oven as set forth in claim 11, wherein the hook protrusion is extended in a forward direction and upwardly such that an end of the hook protrusion is positioned over the slot, thereby retaining the guide bracket in place without a forward displacement or a rearward displacement.

* * * * *